US006255577B1

(12) United States Patent
Imai

(10) Patent No.: US 6,255,577 B1
(45) Date of Patent: Jul. 3, 2001

(54) MELODY SOUND GENERATING APPARATUS

(75) Inventor: Yukihiro Imai, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/521,735

(22) Filed: Mar. 9, 2000

(30) Foreign Application Priority Data

Mar. 18, 1999 (JP) ..... 11-074174

(51) Int. Cl.[7] ..... G10H 7/00
(52) U.S. Cl. ..... 84/609; 84/613; 84/649
(58) Field of Search ..... 84/600–606, 609–613, 84/634–637, 649–652, 666–669

(56) References Cited

U.S. PATENT DOCUMENTS 4,450,742 * 5/1984 Sugiura ..... 84/650
6,100,462 * 8/2000 Aoki ..... 84/613

FOREIGN PATENT DOCUMENTS

2237435 * 5/1991 (GB) .

* cited by examiner

*Primary Examiner*—Robert E. Nappi
*Assistant Examiner*—Marlon Fletcher
(74) *Attorney, Agent, or Firm*—Cooper & Dunham LLP

(57) ABSTRACT

A melody sound generating apparatus includes a musical-scale generator which produces a plurality of musical scales based on a recorded melody pattern, each musical scale being a set of musical notes arranged in a predetermined order and at fixed separations. A melody sound data generator produces an output melody sound data containing a plurality of sets of musical notes based on the plurality of musical scales supplied by the musical-scale generator, by adding the plurality of musical scales together. A sound generating mechanism plays a melody sound based on the output melody sound data supplied by the melody sound data generator.

9 Claims, 2 Drawing Sheets

MELODY SOUND GENERATING APPARATUS

BACKGROUND OF THE INVENTION

1. Field of the Invention

The present invention relates to a melody sound generating apparatus that plays a recorded melody sound in portable telephones or the like. In particular, the present invention relates to a programmable melody sound generating apparatus that reproduces a recorded melody sound including a plurality of sets of musical notes based on different musical scales, as a call-reception sound or a call-hold sound in portable telephones or the like.

2. Description of the Related Art

With recent rapid developments of portable telephones, personal handy phone systems (PHS) or the like, many portable telephones, currently on the market, are equipped with a melody sound generating device, which reproduces a recorded melody sound as a cell-reception sound or a call-hold sound. The call-reception sound is played by the melody sound generating device in order to alarm the user about a call-reception state of the portable telephone. The call-hold sound is reproduced to alarm the user about a call-hold state of the portable telephone.

Further, another type of portable telephone that is equipped with a programmable melody sound generating device is currently known. In this melody sound generating device, a control program enables the user to record a desired melody sample for the call-reception sound or the call-hold sound in the portable telephone.

However, what the above-described melody sound generating devices can reproduce are limited to a melody sound consisting of a set of musical notes based on a single musical scale. The melody sound reproduced has been poor or monotonous in the sense of hearing. It is desirable to provide a melody sound generating device that can reproduce any of a variety of melody sounds in a pleasant sounding way. However, there has been a problem in that such a melody sound generating device that meets this demand requires more complicated circuits with a larger size than the existing melody sound generating devices.

SUMMARY OF THE INVENTION

In order to overcome the problems described above, preferred embodiments of the present invention provide an improved melody sound generating apparatus that is constructed with a simple circuit configuration and effectively reproduces a recorded melody sound including a plurality of sets of musical notes based on different musical scales.

Further, the preferred embodiments of the present invention provide a melody sound generating apparatus that allows the user to easily record a desired melody sample for the call-reception sound or the call-hold sound in a portable telephone.

According to one preferred embodiment of the present invention, a melody sound generating apparatus includes: a musical-scale generator which produces a plurality of musical scales based on a recorded melody pattern, each musical scale being a set of musical notes arranged in a predetermined order and at fixed separations; a melody sound data generator which produces an output melody sound data containing a plurality of sets of musical notes based on the plurality of musical scales supplied by the musical-scale generator, by adding the plurality of musical scales together; and a sound generating mechanism which plays a melody sound based on the output melody sound data supplied by the melody sound data generator.

In the melody sound generating apparatus of the preferred embodiment, the musical-scale generator produces different musical scales based on a recorded melody pattern. The melody sound data generator produces an output melody sound data containing a plurality of sets of musical notes based on the different musical scales. The musical-scale generator and the melody sound data generator in the preferred embodiment can be produced with a simple circuit configuration. The melody sound generating apparatus of the present invention is effective in reproducing a recorded melody sound containing a plurality of sets of musical notes based on different musical scales.

Further, in the melody sound generating apparatus of the preferred embodiment, an input device is provided to input a melody pattern specified by a user, the input melody pattern containing a main tune and associated chords for a desired melody sample. The melody sound generating apparatus of the present invention makes it possible that the user easily record a desired melody sample for the call-reception sound or the call hold sound in a portable telephone.

BRIEF DESCRIPTION OF THE DRAWINGS

Other objects, features and advantages of the present invention will become apparent from the following detailed description when read in conjunction with the accompanying drawings in which.

DETAILED DESCRIPTION OF PREFERRED EMBODIMENTS

A description will now be provided of preferred embodiments of the present invention with reference to the accompanying drawings.

Figure 1:
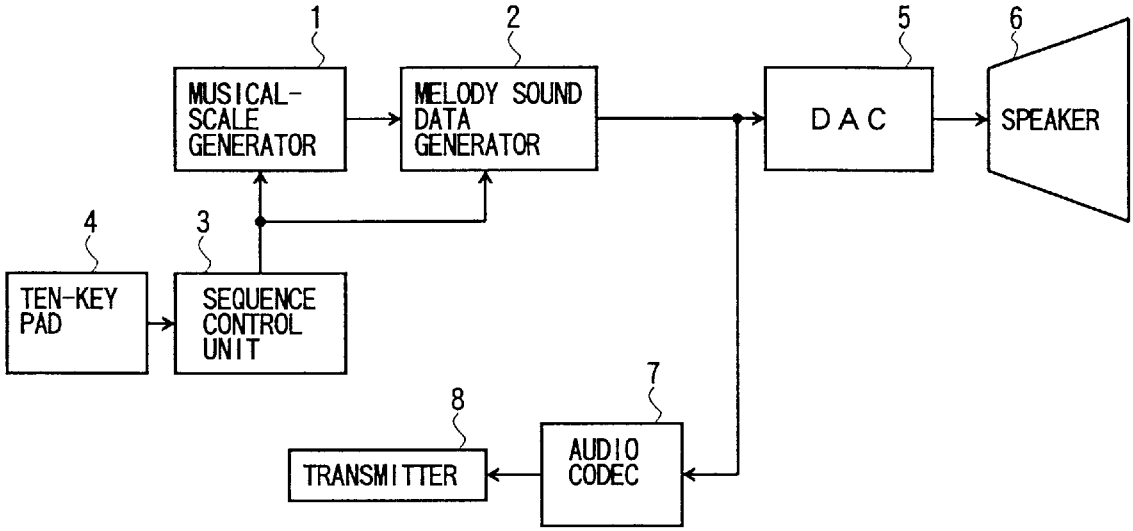
FIG. 1 is a block diagram of one preferred embodiment of a melody sound data generating apparatus of the invention.

FIG. 1 shows one preferred embodiment of the melody sound generating apparatus of the present invention.

The melody sound generating apparatus of the present embodiment is a programmable-type melody sound generating apparatus that is incorporated into a portable telephone or the like. In the programmable type, a control program enables the user to record a desired melody sample for playing the call-reception sound or the call-hold sound in the portable telephone.

As shown in FIG. 1, the melody sound generating apparatus of the present embodiment generally has a musical-scale generator 1, a melody sound data generator 2, and a sequence control unit 3. Suppose that, in the present embodiment, program code instructions that are needed to control the elements of the melody sound generating apparatus are stored into the sequence control unit 3. Also, suppose that, in the present embodiment, a melody pattern that corresponds to the desired melody sample is initially programmed or stored into the sequence control unit 3 on the portable telephone. The melody pattern is arbitrarily specified by the user and usually contains a main tune and associated chords for the desired melody sample. Hereinafter, this memory pattern will be called the recorded melody pattern.

The musical-scale generator 1 produces a first musical scale with respect to the main tune of the recorded melody pattern and second musical scales with respect to the associated chords of the recorded melody pattern in accordance with the instructions of the sequence control unit 3.

Generally, the musical scale refers to a set of musical notes arranged in a predetermined order and at fixed separations, and the musical note refers to a musical sound of a particular length and pitch. Further, the chord refers to a group of three or more musical notes sounded at the same time.

Figure 2:
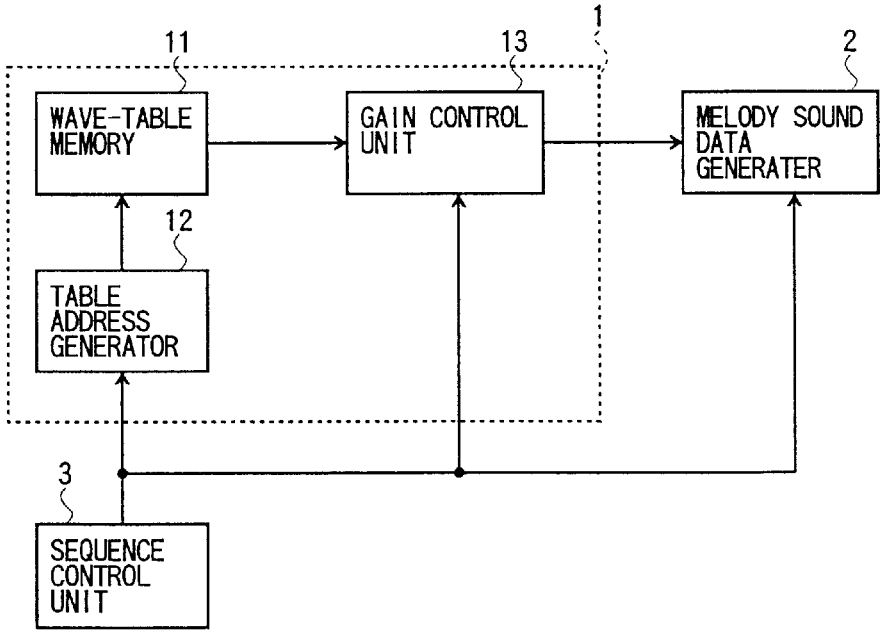
FIG. 2 is a block diagram of a musical-scale generator in the melody sound generating apparatus of FIG. 1.

FIG. 2 shows a musical-scale generator in the melody sound generating apparatus of FIG. 1.

As shown in FIG. 2, the musical-scale generator 1 in the present embodiment generally has a wave-table memory 11, a table address generator 12, and a gain control unit 13. The wave-table memory 11 stores a single cycle of a sinusoidal waveform in a digitized table.

In the musical-scale generator 1 of FIG. 2, the table address generator 12 outputs a sequence of table addresses to the wave-table memory 11 in accordance with the instructions of the sequence control unit 3. This sequence of table addresses corresponds to the recorded melody pattern in the sequence control unit 3. The wave-table memory 11 outputs a digital sound signal to the gain control unit 13 in response to the sequence of table address sent by the table address generator 12. Specifically, when the table addresses related to the main tune of the recorded melody pattern are sequentially sent from the table address generator 12 to the wave-table memory 11, the wave-table memory 11 outputs a corresponding digital sound signal for the first musical scale based on the stored waveform. Also, when the table addresses related to the chords of the recorded melody pattern are sequentially sent from the table address generator 12 to the wave-table memory 11, the wave-table memory 11 outputs a corresponding digital sound signal for the second musical scales based on the stored waveform. Hence, the waveform described by the former digital sound signal and the waveform described the latter digital sound signal contain frequency components which are different from each other.

Further, in the musical-scale generator 1 of FIG. 2, the gain control unit 13 multiplies the digital sound signal, sent from the wave-table memory 11, by a gain factor. The amplitude of the output melody sound that is created by the melody sound generating apparatus can be suitably adjusted by changing the gain factor used in the gain control unit 13. For example, if the gain factor is gradually decreased, the gain control unit 13 makes it possible that the melody sound generating apparatus create an attenuating melody sound. The resulting sound signal is supplied from the gain control unit 13 to the melody sound data generator 2.

In the melody sound generating apparatus of FIG. 1, the melody sound data generator 2 receives the first musical scale and the second musical scales, supplied by the musical-scale generator 1, and produces a melody sound data, containing a plurality of sets of musical notes based on different musical scales, by simply adding the first and second musical scales together.

Figure 3:
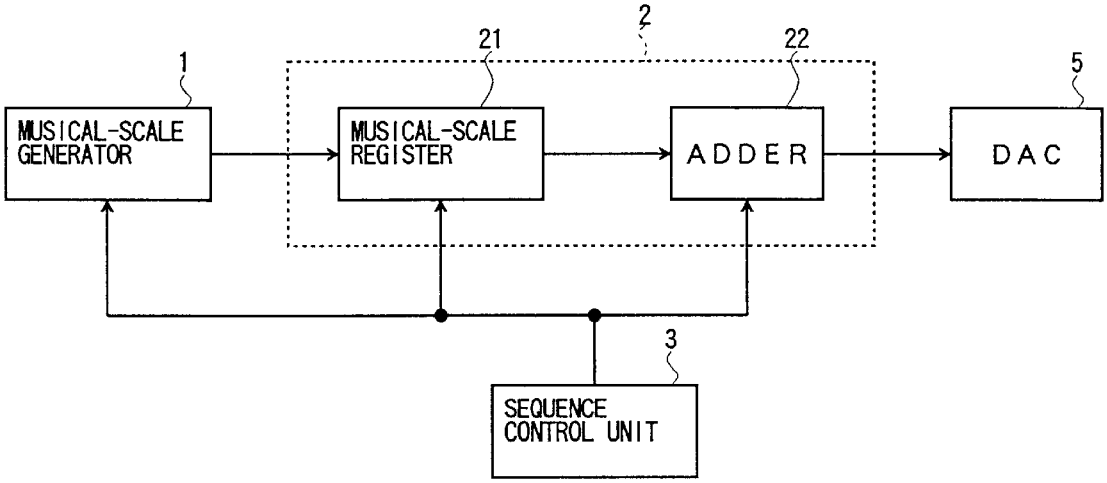
FIG. 3 is a block diagram of a melody sound data generator in the melody sound generating apparatus of FIG. 1.

FIG. 3 shows a melody sound data generator in the melody sound generating apparatus of FIG. 1.

As shown in FIG. 3, the melody sound data generator 2 in the present embodiment generally has a musical-scale register 21 and an adder 22. The musical-scale register 21 temporarily retains the first musical scale with respect to the main tune and the second musical scales with respect to the chords, which are supplied by the gain control unit 13 of the musical-scale generator 1 in accordance with the instructions of the sequence control unit 3.

In the melody sound data generator 2 of FIG. 3, the adder 22 adds the first musical scale and the second musical scales together, which are supplied by the musical-scale register 21 in accordance with the instructions of the sequence control unit 3. This yields the melody sound data containing the plurality of sets of musical notes based on the first and second musical scales. The adder 22 outputs this melody sound data to a sound generating mechanism of the portable telephone in accordance with the instructions of the sequence control unit 3.

Further, the melody sound generating apparatus of FIG. 1 includes a ten-key pad 4, a DAC (digital-to-analog converter) 5, a speaker 6, an audio CODEC (coder-decoder) 7, and a transmitter 8. The DAC 5 and the speaker 6 in the present embodiment constitute a sound generating mechanism of the portable telephone.

As described above, the program code instructions are initially stored in the sequence control unit 3. These instructions are specified by the user on the portable telephone using the ten-key pad 4. The sequence control unit 3 controls the operations of the musical-scale generator 1 and the melody sound data generator 2 in accordance with the specified instructions.

Specifically, the sequence control unit 3 sends a control signal to the musical-scale generator 1, so that the musical scale generator 1 is instructed to produce the first musical scale with respect to the main tune and the second musical scales with respect to the chords based on the recorded melody pattern.

The sequence control unit 3 in the present embodiment instructs the musical-scale generator 1 to supply, when one of the second musical scales accords with the first musical scale, only the first musical scale to the melody sound data generator 2 and discard the one of the second musical scales. Alternatively, the musical-scale generator 1 in this case may supply one of the first musical scale or the one of the second musical scales to the melody sound data generator 2.

Further, the sequence control unit 3 sends a control signal to the melody sound data generator 2, so that the melody sound data generator 2 is instructed to add the first and second musical scales together, so as to produce the melody sound data containing the plurality of sets of musical notes based on the first and second musical scales.

The ten-key pad 4 is an input device provided on the portable telephone. When the portable telephone is placed in a normal operation mode, the ten-key pad 4 is used to input a phone number of a destination party before calling. In the present embodiment, the portable telephone is placed in a melody-setting mode by performing a given control operation, and, during this melody-setting mode, the ten-key pad 4 serves as the input device that inputs a melody pattern specified by the user. The input melody pattern contains the main tune and the associated chords for a desired melody sample and is stored into the sequence control unit 3.

Specifically, when the ten-key pad 4 inputs the main tune of the melody pattern specified by the user, program code instructions that are needed for the musical-scale generator 1 to produce the first musical scale with respect to the main tune of the input melody pattern are stored into the sequence control unit 3. The user follows given melody input procedures and individually specifies each of the musical notes in the main tune of the melody pattern one by one by using the ten-key pad 4. After the main tune of the melody pattern is stored into the sequence control unit 3, the user is prompted to select one of associated chord options for each of the musical notes in the main tune. The user follows given chord input procedures and individually selects one of the associated chord options for each of the musical notes in the main tune. Then, the ten-key pad 4 inputs the chords of the melody pattern specified by the user, and program code instructions that are needed for the musical scale generator 1 to produce the second musical scales with respect to the chords of the input melody pattern are stored into the sequence control unit 3.

In the melody sound generating apparatus of FIG. 1, the DAC 5 is connected to an output of the melody sound data generator 2. The DAC 5 receives the digital sound signal output by the melody sound data generator 2, and converts the digital sound signal into an analog sound signal indicative of the melody sound.

The speaker 6 is connected to an output of the DAC 5. The speaker 6 amplifies the analog sound signal supplied by the DAC 5, and actuates a built-in electromagnet by the amplified sound signal so as to vibrate a cone of the speaker 6. The melody sound is reproduced at the speaker 6 as the call reception sound or the call-hold sound in the portable telephone. This alarms the user about the call-reception state or the call hold state of the portable telephone.

Further, in the melody sound generating apparatus of FIG. 1, the CODEC 7 is connected to the output of the melody sound data generator 2. The transmitter 8 is connected to an output of the CODEC 7. The transmitter 8 and the CODEC 7 are commonly provided on portable telephones or the like. The melody sound generating apparatus is capable of transmitting the digital sound signal, output by the melody sound data generator 2, through the CODEC 7 and the transmitter 8 over a given radio channel.

Next, a description will be given of the operation of the melody sound generating apparatus of the present embodiment when a call is received.

Suppose that the main tune and the chords of the melody pattern that are specified by the user are stored into the sequence control unit 3, and the program code instructions related to the recorded melody pattern are stored into the sequence control unit 3.

When a call-reception state of the portable telephone is detected, the sequence control unit 3 sends a control signal to the musical-scale generator 1. The musical-scale generator 1 at this time is instructed to produce the first musical scale with respect to the main tune and the second musical scales with respect to the chords based on the recorded melody pattern.

The table address generator 12 is instructed to output a sequence of table addresses, corresponding to the recorded melody sequence, to the wave-table memory 11. The wave-table memory 11 is instructed to output a digital sound signal in response to the sequence of table address sent by the table address generator 12. The gain control unit 13 is instructed to output the digital sound signal that is multiplied by the gain factor, to the melody sound data generator 2.

During these processing steps, the sequence control unit 3 instructs the musical-scale generator 1 to supply, when one of the second musical scales accords with the first musical scale, only the first musical scale to the melody sound data generator 2 and discard the accorded second musical scale.

As a next processing step, the sequence control unit 3 sends a control signal to the melody sound data generator 2. The musical-scale register 21 is instructed to retain the first musical scale with respect to the main tune and the second musical scales with respect to the chords, which are supplied by the gain control unit 13. The first and second musical scales are supplied from the musical-scale register 21 to the adder 22.

The adder 22 is instructed to add the first and second musical scales together, so as to produce the melody sound data containing the plurality of sets of musical notes based on the first and second musical scales. Further, the melody sound data generator 2 is instructed to send the melody sound data to the DAC 5. The DAC 5 produces an analog sound signal from the melody sound data sent by the melody sound data generator 2. The speaker 6 reproduces the melody sound based on the analog sound signal sent by the DAC 6, as being the call-reception sound in the portable telephone. Hence, the user is alarmed about the call-reception state of the portable telephone.

In the above-described embodiments, the musical-scale generator 1 produces different musical scales based on a recorded melody pattern. The melody sound data generator 2 produces an output melody sound data containing a plurality of sets of musical notes based on the different musical scales. The musical-scale generator 1 and the melody sound data generator 2 can be produced with a simple circuit configuration, as shown in FIG. 2 and FIG. 3. The melody sound generating apparatus of the above-described embodiment is effective in reproducing a recorded melody sound containing a plurality of sets of musical notes based on different musical scales. It is possible for the melody sound generating apparatus of the above-described embodiment to reproduce a recorded melody sound in a pleasant sounding way.

If the musical-scale generator 1 supplies, when one of the second musical scales accords with the first musical scale, both the accorded musical scales to the melody sound data generator 2, the amplitude of the digital sound signal at the output of the melody sound data generator 2 becomes excessively large or low. To eliminate this problem, the musical-scale generator 1 in the above-described embodiments, the sequence control unit 3 instructs the musical-scale generator 1 to supply one of the first musical scale or the accorded second musical scale to the melody sound data generator 2.

The present invention is not limited to the above-described embodiments, and variations and modifications may be made without departing from the scope of the present invention. For example, the following modifications to the melody sound generating apparatus of the invention are possible.

In the above-described embodiments, the first musical scale with respect to the main tune and the second musical scales with respect to the chords are added together to produce the output melody sound data. Alternatively, the first musical scale with respect to the main tune of the melody pattern, the second musical scales with respect to the chords of the melody pattern, and a third musical scale with respect to a rhythm sound may be added together to produce the output melody sound data. For example, a rhythm sound including musical notes of cymbals may be added to the melody sound.

In the above-described embodiments, the wave-table memory 11 stores a single cycle of a sinusoidal waveform in a digitized table. Alternatively, the melody sound generating apparatus is configured so that the wave-table memory 11 stores a quarter cycle of a sinusoidal waveform in a digitized table. In this modification, it is necessary that the table addresses output by the table address generator 12 and the read-out sequence and polarity of the wave-table memory be suitably adjusted so as to properly produce the first and second musical scales at the output of the musical-scale generator 1.

In the above-described embodiments, the gain control unit 13 is provided in the musical-scale generator 1. However, the gain control unit 13 is not necessarily one of the essential elements of the musical-scale generator 1 according to the invention. Alternatively, the gain control unit 13 may be omitted from the musical-scale generator 1. In this modification, the amplitude of the digital sound signal at the output of the melody sound data generator 2 is not adjusted, but a melody sound including the main tune and the chords can be reproduced.

In the above-described embodiments, the ten-key pad 4 is used to input a melody pattern specified by the user. Alternatively, a personal computer having an input device may be connected to the sequence control unit 3 of the melody sound generating apparatus. The input device on the personal computer may be used instead to input a melody pattern, specified by the used, to the sequence control unit 3.

Further, the present invention is based on Japanese priority application No.11-074174, filed on Mar. 18, 1999, the entire contents of which are hereby incorporated by reference.

What is claimed is:

1. A melody sound generating apparatus comprising:

a musical-scale generator which produces a plurality of musical scales based on a recorded melody pattern, each musical scale being a set of musical notes arranged in a predetermined order and at fixed separations, the plurality of musical scales including a first musical scale related to a main tune of the recorded melody pattern and second musical scales related to associated chords of the recorded melody pattern;

a melody sound data generator which adds the first musical scale and the second musical scales together and generates an output melody sound data based on the first and second musical scales, the output melody sound data containing a plurality of sets of musical notes; and a sound generating mechanism which plays a melody sound based on the output melody sound data supplied by the melody sound data generator.

2. The melody sound generating apparatus according to claim 1, further comprising an input device which inputs a melody pattern specified by a user, the input melody pattern containing a main tune and associated chords for a desired melody sample and being stored into the melody sound generating apparatus, wherein the musical-scale generator supplies a first musical scale with respect to the main tune and second musical scales with respect to the chords, to the melody sound data generator, and the melody sound data generator includes an adder which adds the first musical scale and the second musical scales together, so that the output melody sound data is produced.

3. The melody sound generating apparatus according to claim 2, wherein the musical-scale generator supplies, when one of the second musical scales accords with the first musical scale, one of the first musical scale or said one of the second musical scales to the melody sound data generator.

4. The melody sound generating apparatus according to claim 2, wherein the input device is a ten-key pad provided on a portable telephone.

5. The melody sound generating apparatus according to claim 1, wherein the musical-scale generator includes a wave-table memory which stores a cycle of a waveform in a digitized table.

6. The melody sound generating apparatus according to claim 5, wherein the musical-scale generator includes a table address generator which outputs a sequence of table addresses to the wave-table memory, the sequence of table addresses corresponding to the recorded melody pattern.

7. The melody sound generating apparatus according to claim 5, wherein the musical-scale generator includes a gain control unit which multiplies a digital sound signal, sent from the wave-table memory, by a gain factor.

8. The melody sound generating apparatus according to claim 1, wherein the sound generating mechanism includes a digital-to-analog converter connected to the melody sound data generator, and a speaker connected to the digital-to-analog converter.

9. A melody sound generating method comprising:

generating a plurality of musical scales based on a recorded melody pattern, each musical scale being a set of musical notes arranged in a predetermined order and at fixed separations, the plurality of musical scales including a first musical scale related to a main tune of the recorded melody pattern and second musical scales related to associated chords of the recorded melody pattern;

adding the first musical scale and the second musical scales together and generating an output melody sound data based on the first and second musical scales, the output melody sound data containing a plurality of sets of musical notes; and playing a melody sound based on the generated output melody sound data.

* * * * *